US007762197B1

(12) United States Patent
VanBergen et al.

(10) Patent No.: US 7,762,197 B1
(45) Date of Patent: Jul. 27, 2010

(54) VENTED HYDRAULIC VIBRATOR ASSEMBLY

(75) Inventors: Michael Allen VanBergen, Hart, MI (US); Jerome Papes, Ludington, MI (US)

(73) Assignee: Harsco Technologies LLC, Faimont, MI (US)

( * ) Notice: Subject to any disclaimer, the term of this patent is extended or adjusted under 35 U.S.C. 154(b) by 279 days.

(21) Appl. No.: 11/903,838

(22) Filed: Sep. 25, 2007

(51) Int. Cl.
*E01B 27/20* (2006.01)

(52) U.S. Cl. ..... 104/10; 104/12; 404/133.05; 404/113

(58) Field of Classification Search ..... 104/10, 104/12; 404/113, 133.05
See application file for complete search history.

(56) References Cited

U.S. PATENT DOCUMENTS 1,385,396 A * 7/1921 Rayburn ..... 474/93
4,062,292 A 12/1977 Derler
4,332,200 A * 6/1982 Ganz ..... 104/12
4,555,239 A * 11/1985 Miranti, Jr. ..... 474/93
5,584,248 A * 12/1996 Sandsted et al. ..... 104/12
6,419,420 B2 * 7/2002 Hedlund ..... 404/133.1
6,659,685 B1 * 12/2003 Persson ..... 404/133.1
7,011,607 B2 * 3/2006 Kolda et al. ..... 482/57
7,049,707 B2 * 5/2006 Wurtele ..... 290/1 B

* cited by examiner

*Primary Examiner*—S. Joseph Morano
*Assistant Examiner*—Zachary Kuhfuss
(74) *Attorney, Agent, or Firm*—McNees Wallace & Nurick, LLC

(57) ABSTRACT

A vibrating device having a flywheel rotatably disposed within a housing assembly. The housing assembly includes one or more openings therethrough structured to allow an effective amount of air to pass between the housing assembly enclosed space and the atmosphere. By exchanging an effective amount of air between the enclosed space and the atmosphere, the temperature within the housing assembly remains below the breakdown point of a lubricant used to reduce friction created when the flywheel is in use.

20 Claims, 2 Drawing Sheets

VENTED HYDRAULIC VIBRATOR ASSEMBLY

BACKGROUND OF THE INVENTION

1. Field of the Invention

This invention relates to a railroad track ballast tamping device and, more specifically, to a tamping device wherein a vibration motor has a housing with air passages.

2. Background Information

The gravel-like ballast underlying a railroad track must be compressed during the installation of new track or repairing old track. The typical means for compressing the railroad track ballast is to vibrate and/or tamp the ballast using a tamping machine. A tamping machine, which is mounted on a rail vehicle, typically consists of at least two pairs of tamping tools connected to a common vibrating device. Each tamping tool includes an elongated tamping head which is structured to be inserted into the ballast. An individual tamping head may include a fork-like tip with two, or more, prongs. A pair of tamping tools is further structured to move in a pincer-like manner. Typically in a pair of tamping tools, the individual tamping heads are in a spaced relation to each other so that the tamping heads may be inserted into the ballast on either side of a tie. The tamping heads are aligned so that the heads of an associated pair of tamping tools are disposed on one side of a rail. Further, a second pair of tamping tools is, typically, adjacent to the first pair but located on the other side of the rail. Thus, during a tamping operation, at the location of the intersection of a rail and tie, a tamping head will be disposed on each side of the tie and on each side of the rail. The tamping machine further, typically, includes two pairs of tamping tools disposed over each of the two rails in a railroad track.

During the tamping operation, the tamping heads are usually in a generally vertical orientation when inserted into the ballast. The tamping heads of an associated pair of tamping tools are then drawn together in a pincer-like motion so that the tamping heads are generally adjacent to a selected tie. The vibrating device is then actuated causing the tamping heads to vibrate and compress the ballast. The tamping heads are then removed from the ballast and the tamping machine is indexed, that is moved, to the next tie and the operation is repeated.

The vibrating device is coupled to each tamping tool. That is, each tamping tool may have a dedicated, or individual, vibrating device or a vibrating device may be mounted on a cross-member extending between the two or more tamping tools located on one side of a rail. The vibrating device, typically, includes an irregular flywheel that is rotated at high speed. The irregular shape of the flywheel causes the flywheel to vibrate during rotation. The vibration from the flywheel is mechanically transferred to the tamping heads via the tamping tool housing or frame assembly. That is, the flywheel typically rotates about a hub which has an axis of rotation that extends generally parallel to the ties and generally perpendicular to the rails. The hub engages a pair of bearings, one bearing on each side of the flywheel and is coupled to a motor. The flywheel and bearings are disposed within a closed housing assembly. The housing assembly is coupled, and preferably fixed, to the tamping tool frame assembly. The housing assembly is typically sealed. That is, the housing assembly is, essentially, airtight. However, there may be small passages that allow an insignificant amount of air to pass in and out of the housing assembly.

During a tamping operation the rotation of the flywheel creates friction with the bearings. Thus, a lubricant is typically applied to the bearings. The lubricant is structured for normal operations in open spaces and moderate environmental temperatures. While a sealed housing assembly generally provides acceptable performance, it has been noted that in warmer climates or in closed spaces, e.g. a tunnel, heat builds up within the closed housing assembly. When the heat buildup is not relieved, the temperatures within the housing assembly may pass the breakdown point of the lubricant. When the lubricant breaks down, the friction between the moving components cause enhanced wear and tear and, in very rare instances, may cause a complete failure of the vibrating device. Additionally, lubricant formulas are subject to change by various manufacturers. It has been observed that lubricants that have been acceptable in one formulation may be subject to heat related breakdown in a later formulation. Further, even when a lubricant does not fail due to an instance of excessive heat, the high operating temperatures cause the lubricants to wear out more rapidly.

SUMMARY OF THE INVENTION

The disclosed concept addresses the problem of lubricant break down in enclosed spaces and in high temperatures by providing an improved housing assembly for a tamping machine vibrating device. The vibrating device housing assembly includes one or more openings therethrough structured to allow an effective amount of air to pass between the housing assembly enclosed space and the atmosphere. By exchanging an effective amount of air between the enclosed space and the atmosphere, the temperature within the housing assembly remains below the breakdown point of the lubricant.

Preferably, the exchange of air is accomplished by the rotation of the vibrating device flywheel. That is, as the flywheel rotates, the flywheel causes a portion of the heated air within the housing assembly enclosed space to be expelled through one housing assembly opening. As the heated air is expelled, an equal volume of cool air is drawn into the housing assembly enclosed space via another opening or, if the openings have an extended length, through another portion of the same opening.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, an "effective amount of air" means a volume of air sufficient to absorb a quantity of heat whereby the removal of the volume of air will prevent the ambient temperature at the original location of the volume of air from increasing beyond a selected temperature.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are so coupled to move as one.

Figure 1:
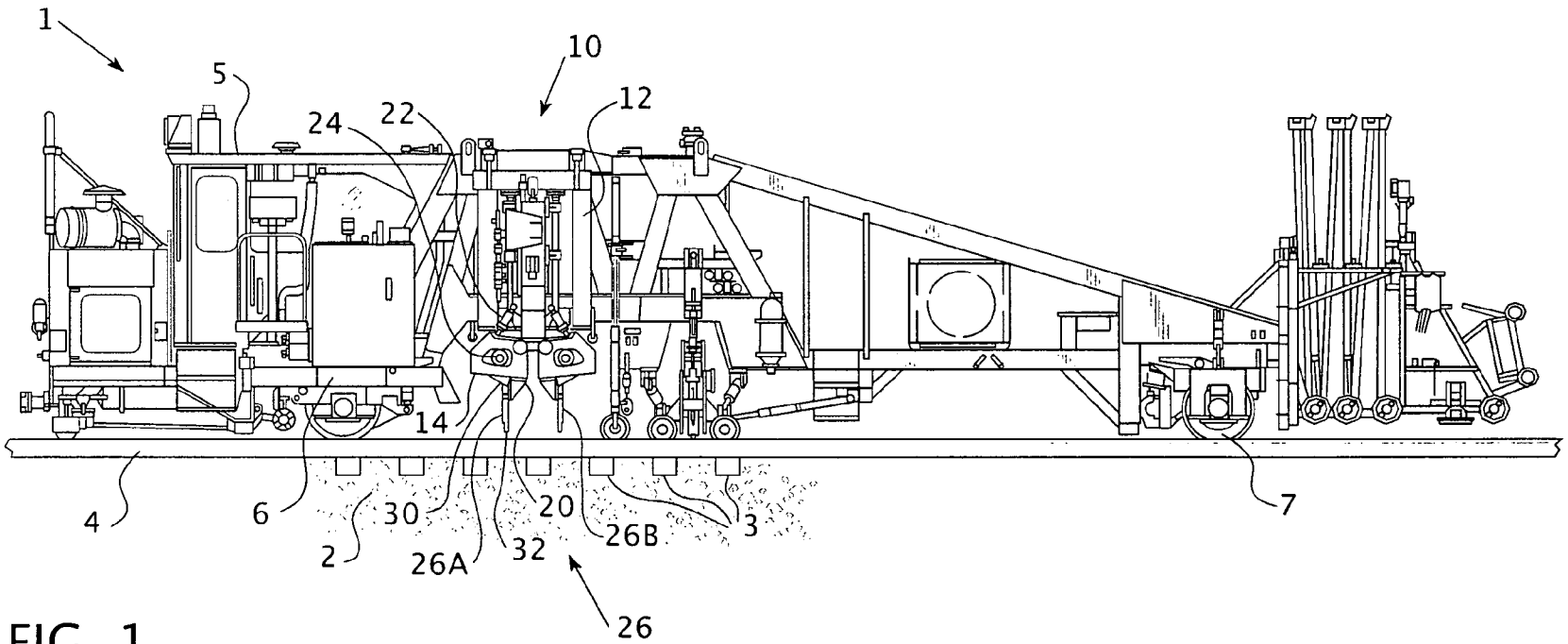
FIG. 1 is a schematic side view of a rail vehicle with a tamping machine.

A tamping machine 10 structured to be coupled to a rail vehicle 5 is shown in FIG. 1. As is known, a railroad 1 includes a ballast 2 substrate upon which a plurality of ties 3 are disposed. One or more pairs of rails 4 are coupled to the ties 3. A rail vehicle 5 includes a body 6 having a plurality wheels 7 coupled thereto. The wheels 7 are structured to travel over the railroad 1. As shown, the rail vehicle 5 includes a number of other devices that are not recited in the claims below. The tamping machine 10 includes a frame assembly 12 and at least one tamping tool 14. The frame assembly 12, which typically includes a lifting device such as, but not limited to pneumatic or hydraulic pistons, is coupled to the rail vehicle 5 and is structured to raise and lower the at least one tamping tool 14 as described below.

The at least one tamping tool 14 includes a mounting plate 20, an actuation device 22, a vibrating device 24, and at least one elongated tool head 26. Typically, there are two tool heads 26A, 26B structured to move in a pincer-like fashion. The mounting plate 20 is pivotally coupled to the frame assembly 12. The actuation device 22 and the vibrating device 24 are coupled to the mounting plate 20. The axis of rotation of the mounting plate 20 extends generally laterally, that is, perpendicular to the rails 4. The actuation device 22 is structured to pivot the at least one tool head 26 between a first position, wherein the at least one tool head 26 is spaced from a tie 3, and a second position wherein the tool head 26 is adjacent to a tie 3. The at least one tool head 26 has an upper end 30 and a lower end 32. The at least one elongated tool head upper end 30 is coupled to the mounting plate 20. The at least one elongated tool head lower end 32 is structured to be inserted into the ballast 2. The at least one elongated tool head lower end 32 may be separated into two or more prongs.

Figure 2:
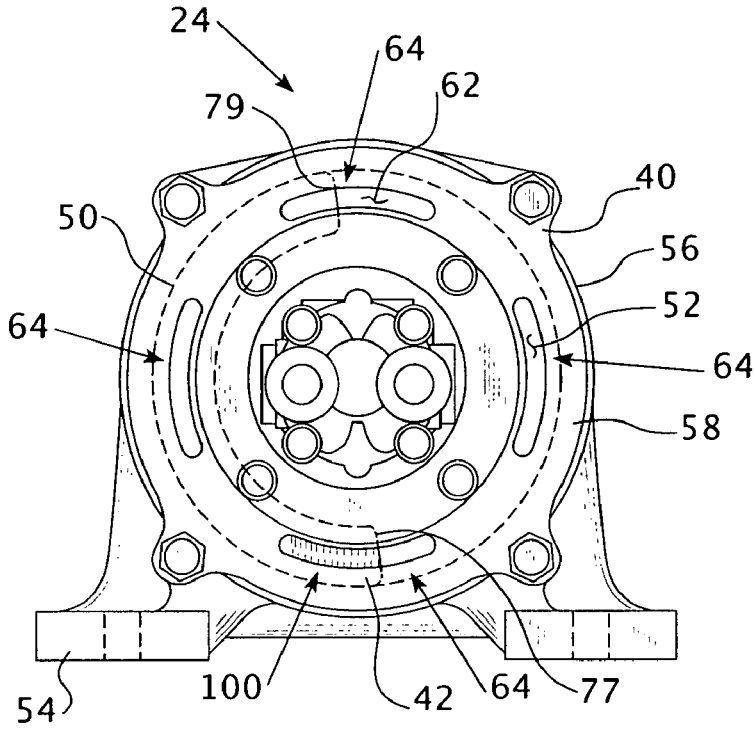
FIG. 2 side view of a tamping machine vibration device.
Figure 3:
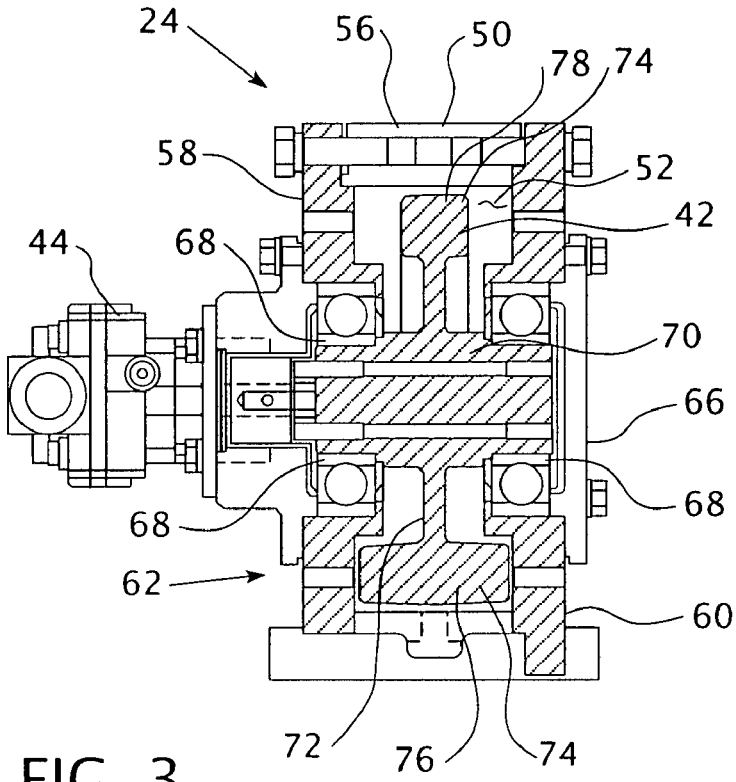
FIG. 3 is a partial cross-sectional side view of a tamping machine vibration device.

The vibrating device 24 is structured to vibrate the at least one tool head 26, as discussed below. The vibrating device 24 is coupled to, and preferably fixed to, the mounting plate 20. As shown in FIGS. 2 and 3, the vibrating device 24 includes a housing assembly 40, an irregular flywheel 42, and a motor 44. The housing assembly 40 includes a plurality of sidewalls 50 defining a substantially enclosed space 52. The housing assembly 40 may define any shape, however, as shown, the housing assembly 40 typically is shaped as a short, wide cylinder with a generally horizontal axis and having a pair of mounting feet 54. In this configuration, the housing assembly 40 includes a generally circular sidewall 56, a first sidewall 58 and a second sidewall 60.

At least one housing assembly sidewall 58, 60 has at least one opening 62 structured to allow an effective amount of air to pass therethrough. Preferably, both housing assembly sidewalls 58, 60 include a plurality of elongated, arc-shaped slots 64. The arc-shaped slots 64 are preferably disposed in a circular pattern with the center of the circle generally corresponding to the axis of rotation of the irregular flywheel 42, however, other patterns may be used as well. As discussed below, the irregular flywheel 42 has a diameter; the arc-shaped slots 64 are preferably disposed adjacent to the maximum diameter of the irregular flywheel 42. The housing assembly sidewalls 58, 60 may also have axial access openings, however, such openings are covered by a side plate 66 or the motor 44. The housing assembly 40 also include bearings 68 structured to support the irregular flywheel 42. The circular sidewall 56 may include one or more drain holes 69 at or near the lowest point.

The irregular flywheel 42 is rotatably disposed in the enclosed space 52 and structured to rotate about an axis of rotation. The purpose of the irregular flywheel 42 is to produce a vibration when rotated, typically at a high speed. As such, various irregularities may be incorporated into the irregular flywheel 42 to produce the desired vibrating effect. In the preferred embodiment, the irregular flywheel 42 also causes air to move in and out of the enclosed space 52 via the at least one opening 62. In the preferred embodiment, the irregular flywheel 42 has a body 70 having a disk portion 72 and a perimeter portion 74. The disk portion 72 preferably has a constant thickness. The perimeter portion 74 has a thick section 76 and a thin section 78. The thick section 76 extends over about 180 degrees of the circumference of the disk portion 72. The thin section 78 extends over the other about 180 degrees of the circumference of the disk portion 72. Due to the difference in the shape of the perimeter portion 74 of the irregular flywheel 42, rotation of the irregular flywheel 42 creates a vibration.

The motor 44 has a housing 80 and a shaft 82. The motor housing 80 is coupled, and preferably fixed, to the housing assembly 40. The motor shaft 82 is coupled to the irregular flywheel 42 and structured to rotate the irregular flywheel 42 as indicated by the arrow "A.".

When the vibrating device 24 is assembled, the irregular flywheel 42 is disposed within the enclosed space 52 and supported by the bearings 68. The motor 44 is coupled to the irregular flywheel 42. The side plate 66 and the motor 44 cover the axial access openings in the housing assembly sidewalls 58, 60. Thus, except for the drain hole 69, the only openings through the housing assembly sidewalls 58, 60 are the arc-shaped slots 64 disposed adjacent to the maximum diameter of the irregular flywheel 42. Further, an air filter 100, such as, but not limited to, a brush, may be disposed over the housing assembly at least one opening 62.

In this configuration, the rotation of the irregular flywheel 42 causes an effective amount of air to pass through the arc-shaped slots 64. As the irregular flywheel 42 rotates, the flywheel thick section 76 has a leading edge 77 and the flywheel thin section 78 has a leading edge 79. As the irregular flywheel 42 rotates about the axis of rotation, heated air adjacent to the irregular flywheel thick section leading edge 77 and within the enclosed space 52 is expelled from the enclosed space 52 via an elongated slot 64. Similarly, as the irregular flywheel 42 rotates about the axis of rotation, cooler air adjacent to the irregular flywheel thin section leading edge 79 and disposed outside of the enclosed space 52 is drawn into said enclosed space 52 via said elongated slot 64. That is, the rotation of the irregular flywheel 42 generally increases the pressure of the air in the enclosed space 52 in front of the irregular flywheel thick section leading edge 77. This increase in pressure causes the heated air in the enclosed space 52 to be vented. As the heated air is vented, cool air is drawn into the enclosed space 52 to replace the exhausted air. In this manner, the temperature within the vibrating device 24 may be controlled so that the temperature does not exceed a selected maximum.

While specific embodiments of the invention have been described in detail, it will be appreciated by those skilled in the art that various modifications and alternatives to those details could be developed in light of the overall teachings of the disclosure. For example, the irregular flywheel 42 may incorporate features to enhance the amount of air moved. That is, the irregular flywheel 42 may include one or more radial ridges (not shown) that act in a manner similar to fan blades and which increase the pressure in front of the irregular flywheel thick section leading edge 77 thereby increasing the amount of air exchanged. Accordingly, the particular arrangements disclosed are meant to be illustrative only and not limiting as to the scope of the invention which is to be given the full breadth of the claims appended and any and all equivalents thereof.

What is claimed is:

1. A housing assembly for a tamping machine vibrating device, said housing assembly comprising:

a plurality of sidewalls defining a substantially enclosed space;

at least one sidewall having at least one opening structured to allow an effective amount of air to pass therethrough;

the at least one opening is disposed adjacent a maximum diameter of an irregular flywheel disposed in the housing assembly, the at least one opening includes a dust filter; and whereby an effective amount of air may pass between said enclosed space and the atmosphere.

2. The housing assembly of claim 1 wherein said at least one opening is an elongated slot.

3. The housing assembly of claim 2 wherein said irregular flywheel has with a diameter and structure to rotate about an axis and wherein:

said elongated slot is an arcuate slot.

4. The housing assembly of claim 3 wherein:

said at least one opening includes a plurality of openings disposed in a generally circular pattern.

5. A vibrating device for a tamping machine comprising:

a housing assembly having a plurality of sidewalls defining a substantially enclosed space;

at least one housing assembly sidewall having at least one opening structured to allow an effective amount of air to pass therethrough;

an irregular flywheel rotatably disposed in said enclosed space and structured to rotate about an axis of rotation;

a motor coupled to, and structured to rotate, said irregular flywheel;

wherein the rotation of said irregular flywheel causes air within said enclosed space to move out of said enclosed space via said housing assembly sidewall at least one opening which further causes air from the atmosphere to be drawn into said enclosed space via said housing assembly sidewall at least one opening; and wherein the amount of air exchanged is an effective amount of air.

6. The vibrating device of claim 5 wherein said at least one opening is an elongated slot.

7. The vibrating device of claim 6 wherein:

said elongated slot is an arcuate slot; and said slot disposed adjacent to the maximum diameter of said flywheel.

8. The vibrating device of claim 7 wherein:

said at least one opening includes a plurality of openings disposed in a generally circular pattern.

9. The vibrating device of claim 8 wherein:

each said arcuate elongated slot has a center generally corresponding to the axis of rotation of said flywheel.

10. The vibrating device of claim 5 wherein said at least one opening includes a dust filter.

11. The vibrating device of claim 5 wherein:

said flywheel includes a body having a disk portion and a perimeter portion; and said perimeter portion having a thick section and a thin section, said thick section extending over about 180 degrees of the circumference of said disk portion, said thin section extending over the other about 180 degrees of the circumference of said disk portion.

12. The vibrating device of claim 11 wherein:

said at least one opening is an elongated slot;

wherein said flywheel thick section has a leading edge;

wherein said flywheel thin section has a leading edge;

wherein, as said flywheel rotates about said axis of rotation, air adjacent to said flywheel thick section leading edge and within said enclosed space is expelled from said enclosed space via said elongated slot; and whereas, as said flywheel rotates about said axis of rotation, air adjacent to said flywheel thin section leading edge and disposed outside of said enclosed space is drawn into said enclosed space via elongated slot.

13. The vibrating device of claim 12 wherein:

said elongated slot is an arcuate slot; and said slot disposed adjacent to said flywheel perimeter portion.

14. The vibrating device of claim 13 wherein:

said at least one opening includes a plurality of openings disposed in a generally circular pattern.

15. A tamping machine structured to be coupled to a rail vehicle, said rail vehicle structured to travel over a railroad having a plurality of ties and an underlying ballast, said tamping machine comprising:

at least one tamping tool having a mounting plate, an actuation device, a vibrating device, and at least one elongated tool head, said actuation device and said vibrating device coupled to said mounting plate;

said actuation device structured to pivot said at least one tool head between a first position, wherein said at least one tool head is spaced from a tie, and a second position wherein said tool head is adjacent to a tie;

said vibrating device structured to vibrate said at least one tool head;

said at least one tool head having an upper end and a lower end, said at least one elongated tool head upper end coupled to said mounting plate, said at least one elongated tool head lower end structured to be inserted into said ballast;

a frame assembly, coupled to said rail vehicle and to move said at least one tool head between a position above said ballast and a position wherein said at least one tool head is partially inserted into said ballast;

said at least one elongated tool head coupled to said frame assembly;

said vibrating device having a housing assembly, an irregular flywheel, and a motor;

said housing assembly having a plurality of sidewalls defining a substantially enclosed space;

at least one housing assembly sidewall having at least one opening structured to allow an effective amount of air to pass therethrough;

said irregular flywheel rotatably disposed in said enclosed space and structured to rotate about an axis of rotation;

said motor coupled to, and structured to rotate, said irregular flywheel; and wherein the rotation of said irregular flywheel causes air within said enclosed space to move out of said enclosed space via said housing assembly sidewall at least one opening which further causes air from the atmosphere to be drawn into said enclosed space via said housing assembly sidewall at least one opening and wherein the amount of air exchanged is an effective amount of air.

16. The tamping machine of claim 15 wherein said at least one opening is an elongated slot.

17. The tamping machine of claim 16 wherein:

said elongated slot is an arcuate slot; and said slot disposed adjacent to the maximum diameter of said flywheel.

18. The tamping machine of claim 17 wherein:

said at least one opening includes a plurality of openings disposed in a generally circular pattern.

19. The tamping machine of claim 18 wherein:

each said arcuate elongated slot has a center gradually corresponding to the axis of rotation of said flywheel.

20. A housing assembly for a tamping machine vibrating device, said housing assembly comprising:

a plurality of sidewalls defining a substantially enclosed space;

at least one sidewall having at least one opening structured to allow an effective amount of air to pass therethrough;

an irregular flywheel disposed in the enclosed space, the irregular flywheel being rotatably disposed in said enclosed space and structured to rotate about an axis of rotation, the at least one opening is disposed adjacent a maximum diameter of the irregular flywheel;

whereby an effective amount of air may pass between said enclosed space and the atmosphere.

* * * * *